US005997195A

United States Patent [19]

Bürgin

[11] Patent Number: 5,997,195

[45] Date of Patent: Dec. 7, 1999

[54] PRINTER RIBBON SPOOL HAVING A CONNECTION OF AN END PIECE WITH A CARDBOARD TUBE CORE

[75] Inventor: Markus Bürgin, Uster, Switzerland

[73] Assignee: Pelikan Produktions AG, Switzerland

[21] Appl. No.: 09/088,100

[22] Filed: Jun. 1, 1998

[30] Foreign Application Priority Data

Jun. 2, 1997 [DE] Germany ..... 197 23 076

[51] Int. Cl.[6] ..... B65H 75/00

[52] U.S. Cl. ..... 400/242; 400/243; 242/118.61; 242/608

[58] Field of Search ..... 400/242, 243, 400/246; 242/596.7, 599.4, 599, 597.6, 118.61, 608, 608.6

[56] References Cited

U.S. PATENT DOCUMENTS

| | | | |
|---|---|---|---|
| 1,672,167 | 3/1928 | Mossberg | 400/242 X |
| 1,919,769 | 8/1933 | Brown et al. | 242/613.5 |
| 1,999,765 | 4/1935 | Laveau | 242/118.61 |
| 2,928,619 | 3/1960 | Burton et al. | 242/571.4 |
| 3,770,221 | 11/1973 | Stern | 242/55.2 |
| 4,984,915 | 1/1991 | Tashiro et al. | 400/242 X |
| 5,597,135 | 1/1997 | Vandersteene | 242/599.4 |
| 5,628,475 | 5/1997 | Warnaar | 242/596.7 |

FOREIGN PATENT DOCUMENTS

| | | |
|---|---|---|
| 19 00 451 | of 0000 | Germany . |
| 69 08 826 | of 0000 | Germany . |
| 12 11 529 | 7/1962 | Germany . |

*Primary Examiner*—Edgar Burr
*Assistant Examiner*—Minh H. Chau
*Attorney, Agent, or Firm*—Fay, Sharpe, Beall, Fagan, Minnich & McKee, LLP

[57] ABSTRACT

A tube-shaped stub (5) of an end piece (2) is inserted into ribbon tube core (1). The stub (5) has, adjacent to its free end, hook-like projections (11). This achieves secure anchoring of the end piece (2) in the core (1), even under changing climatic conditions.

7 Claims, 2 Drawing Sheets

PRINTER RIBBON SPOOL HAVING A CONNECTION OF AN END PIECE WITH A CARDBOARD TUBE CORE

BACKGROUND OF THE INVENTION

The present invention relates to the art of printing devices. It finds particular application in conjunction with printing ribbon holders. It is to be appreciated, however, that the present invention will have applications to other spool-type devices.

Wide color ribbons, for example, for telex machines, are usually wound on cardboard tube cores. In order to support, put into motion, or brake these cores in a printer, end pieces which have a tube-shaped stub are inserted at both extremities. These are made of plastic. It has been demonstrated that specifically under changing climatic conditions, these end pieces do not maintain a secure connection to the core.

The present invention provides a new and improved printer ribbon tube which overcomes the above problems and others. This objective is solved by the combined features of the claims.

SUMMARY OF THE INVENTION

In accordance with the present invention, a new and improved printing ribbon spool is provided. A cardboard tube core has two open ends. An end piece is connected to one of the open ends and includes a tube-shaped stub inserted into the open end of the tube core. A plurality of longitudinal ribs (7) are formed on an exterior surface (8) of the stub (5) where the ribs (7) have a swallow-tail cross-section.

One advantage of the present invention is that it provides a secure connection between a tube core and its end piece even under changing climatic conditions.

Another advantage of the present invention is that it provides a securely connected ribbon spool such that its members are maintained in connection to each other while the ribbon spool is rotated.

Another advantage of the present invention is that the shape of the longitudinal ribs provide a better torque transmission between the cardboard core and the end piece with minimum displacement of the cardboard of the core. This results is low force requirements for mounting and a practically unobstructed outer cylindrical circumference of the core.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENT

Figure 1:
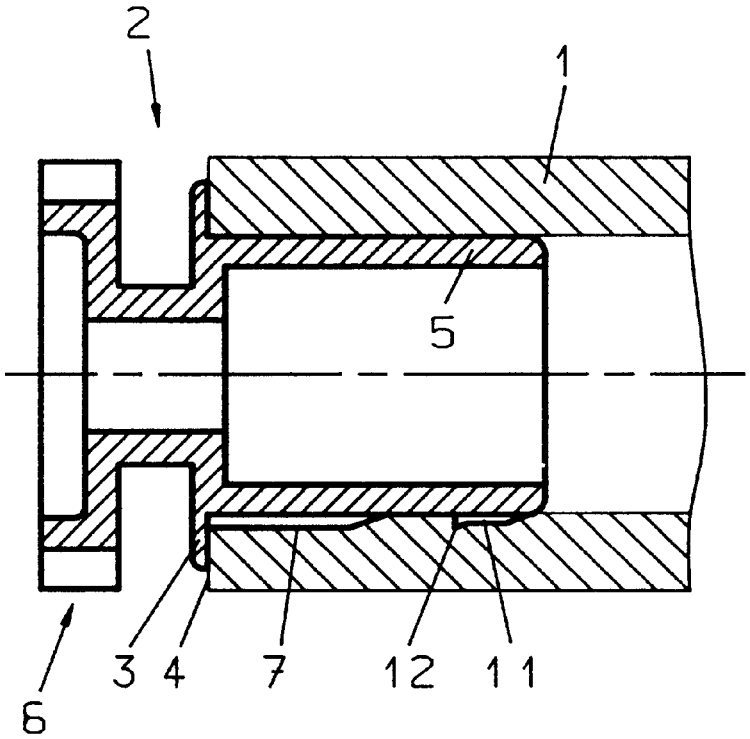
FIG. 1 is an axial cross-section through a ribbon tube and end bearing which is a first embodiment of the present invention.
Figure 2:
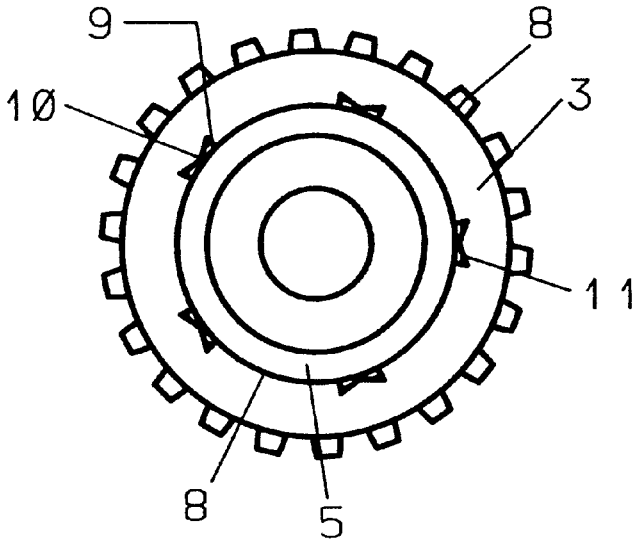
FIG. 2 is a front view of the end bearing.
Figure 3:
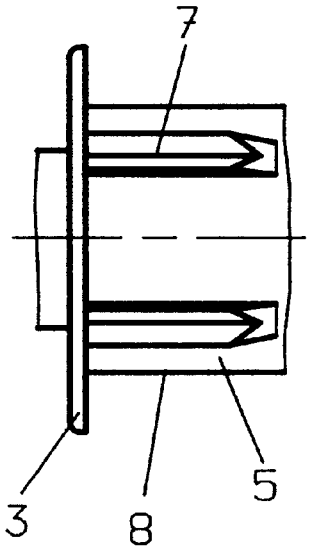
FIG. 3 is a lateral view of a portion of the end bearing.

With reference to FIGS. 1–3, a ribbon spool includes a circular-cylindrical cardboard tube core 1 and bearing member 2 inserted in same on both open ends. The bearing member 2 has a flange 3 which abuts a front surface 4 of core 1 and which has a tube-shaped stub 5 which is inserted in the core 1. One of the two bearing members 2 of the wind-up spool additionally has a formed-on toothed wheel 6. Longitudinal ribs 7 are uniformly distributed over an exterior surface 8 of the stub 5 and extended over approximately half of the length. Starting from flange 3, the longitudinal ribs 7, which in cross-section, are swallow-tail shaped, and pass, at their free end, in the form of a cone into the exterior surface 8 of the stub 5. Outer flanks 9 are formed on the longitudinal ribs 7 and are approximately radially oriented and pass angularly into a V-shaped recess 10. Thus, bearing member 2 and core 1 are joined to each other torsion-proof. In the extensions of the ribs 7, hook-like or saw-tooth-shaped projections 11 are formed on the exterior surface 8. Tooth 12 has a steep flank oriented toward the flange 3. Following installation of the bearing member 2 into the core 1, the projections 11 wedge themselves in the core 1. Thus, permanent hold of bearing member 2 in core 1 is attained.

Figure 4:
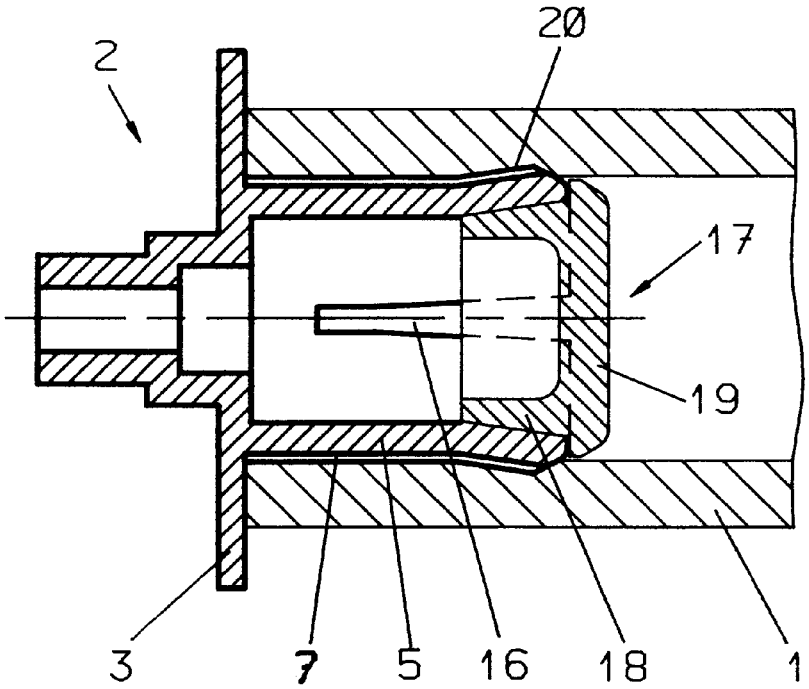
FIG. 4 is an axial cross-section of an alternative embodiment of the present invention.

In an alternative embodiment according to FIG. 4, the ribs 7 are continuous. The stub 5 has several longitudinal slots 16 distributed over the circumference. Into the free end of stub 5 is inserted a spreader element 17 in the form of a casing 18 with a lid 19. The spreader element 17 spreads out the free end of the stub 5 which also forms a spread-out free end 20 of the ribs 7. Tests have shown that specifically after several weeks of embedment time, sufficiently rigid connection in an axial direction is attained between the support element 2 and core 1 because the spread-out free ends 20 of ribs 7 settle in the cardboard of core 1.

Figure 5:
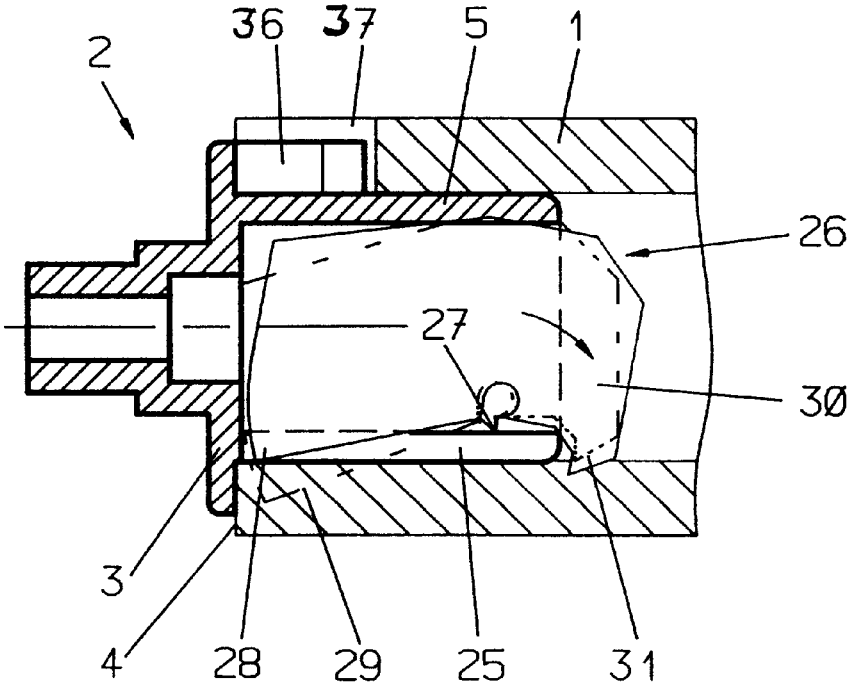
FIG. 5 is an axial cross-section of another embodiment of the present invention.

In another embodiment according to FIG. 5, the stub 5 has a longitudinal slot 25. A double-armed lever 26 is inserted in stub 5 which is rotatable around an axis 27. A longer lever arm 28 protrudes, in an unmounted state, next to the flange 3, beyond the outer surface with plane 29 inclined toward the axis of the stub. A shorter lever arm 30 is hook-shaped. Immediately prior to flange 3 being positioned against the front surface 4, arm 28 is pressed in and the lever 26 swivelled in a direction indicated by the arrow, so that hook 31 of arm 30 enters into the core 1. A secure connection is thus achieved. At one location of the circumference, the core 1 has, starting from the front surface 4, a longitudinal slot 37. The longitudinal slot engages a retaining strip, which is formed onto stub 5, and which is slightly wedge-shaped at its interior end. This achieves a secure, torsion-proof connection. It is, however, also possible to omit slot 37 and strip 36, and to provide instead longitudinal ribs 7, as in the embodiment shown in FIGS. 1–3.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A printing ribbon spool for a printing device comprising:

a cardboard tube core (1) having two open ends;

an end piece (2) connected to one of the open ends, the end piece (2) including a tube-shaped stub (5) inserted into the open end of the tube core (1); and a plurality of longitudinal ribs (7) formed on an exterior surface (8) of the stub (5), the ribs (7) having a swallow-tail cross-section defined by outer flanks (9) oriented substantially radially to an axis of the stub (5) and a V-shaped recess (10) between opposed flanks (9) of the same rib (7).

2. The printing ribbon spool according to claim 1, wherein the stub (5) includes a plurality of hook-like projections (11) distributed over the exterior surface, the projections (11) being in axial alignment with the ribs (7).

3. The printing ribbon spool according to claim 2, wherein the projections (11), adjacent their end proximate said open end of said core, have substantially the same cross-section as the longitudinal ribs.

4. The printing ribbon spool according to claim 1, wherein an end of the longitudinal ribs (7) is one of wedge-shaped and cone-shaped, said end corresponding to one which, in relation to said open end of said core (1), is farther in said core (1).

5. The printing ribbon spool according to claim 1, wherein the stub (5) is slotted and has a free end in which a spreader element (17) is inserted such that the longitudinal ribs (7) diverge toward said free end.

6. The printing ribbon spool according to claim 1, wherein the stub (5) has a longitudinal slot (25) in which engages a double-armed tiltable lever (26) having a first arm (28) which, in a basic position, next to a flange (3) of the end piece (2) projects beyond the exterior circumference (8) of the stub (5) with a plane (29) inclined towards an axis of the stub (5), and having a second arm (30) including a hook (31) which, when the first arm (28) is pressed in, protrudes beyond the exterior circumference of the stub (5).

7. A connection of an end piece (2) with a cardboard tube core (1) adapted to wind a printing ribbon, wherein a tube-shaped stub (5) of the end piece (2) is inserted in a free end of the core (1), a flange (3) being formed on the end piece (2) adjoining the stub (5) and abutting the end of the core (1), wherein a plurality of hook-like projections (11) distributed over an exterior surface (8) of the stub (5) extend from the exterior surface (8), the projections having steep flanks facing the flange (3), the projections(11) have, as seen in an axial projection of the stub (5), a swallow-tail shape including outer flanks (9) facing away from each other which are generally radially oriented and a V-shaped groove (10) joining the outer flanks.

* * * * *